US008161847B1

(12) United States Patent
Considine

(10) Patent No.: US 8,161,847 B1
(45) Date of Patent: Apr. 24, 2012

(54) SOCKET WRENCH APPARATUS

(76) Inventor: Daniel Considine, Quitman, GA (US)

( * ) Notice: Subject to any disclaimer, the term of this patent is extended or adjusted under 35 U.S.C. 154(b) by 0 days.

(21) Appl. No.: 13/135,585

(22) Filed: Jul. 11, 2011

Related U.S. Application Data

(63) Continuation-in-part of application No. 12/322,871, filed on Feb. 9, 2009, now abandoned.

(51) Int. Cl.
*B25B 13/46* (2006.01)
*B25B 23/16* (2006.01)

(52) U.S. Cl. ..... 81/60; 81/177.8; 81/124.4; 81/125.1

(58) Field of Classification Search ..... 81/177.7–177.9, 81/124.4, 124.5, 125.1, 60
See application file for complete search history.

(56) References Cited

U.S. PATENT DOCUMENTS

| | | | | |
|---|---|---|---|---|
| 1,747,527 | A * | 2/1930 | Peterson | 81/177.8 |
| 1,811,137 | A * | 6/1931 | Kress | 81/124.3 |
| 6,637,299 | B1 * | 10/2003 | Steele | 81/124.5 |
| 6,971,292 | B2 * | 12/2005 | Hu | 81/177.8 |
| 7,024,970 | B2 * | 4/2006 | Boman | 81/177.8 |
| 7,036,403 | B2 * | 5/2006 | Lin | 81/177.8 |
| 7,044,028 | B1 * | 5/2006 | Lozano et al. | 81/60 |
| 7,246,543 | B1 * | 7/2007 | Patti | 81/124.5 |
| 7,316,172 | B1 * | 1/2008 | Chen et al. | 81/177.2 |

* cited by examiner

*Primary Examiner* — Debra S Meislin
(74) *Attorney, Agent, or Firm* — Harpman & Harpman

(57) ABSTRACT

A socket wrench device having multiple adjustable fastener engagement tool ends. A pair of ratchet engagement heads are pivotally secured in respective rotational and supportive orientation with extending handles pivoted together at their free ends to afford multiple socket engagement orientation by compound pivot and socket rotation within a single hand tool configuration.

4 Claims, 4 Drawing Sheets

SOCKET WRENCH APPARATUS

This application is a continuation in part based on Ser. No. 12/322,871, filed Feb. 9, 2009 now abandoned.

BACKGROUND OF THE INVENTION

1. Technical Field

This invention relates to hand tools specifically ratchet engagement heads adapted to one-way locking rotation of a fastener head engaged thereon. Such tools are generally referred to as socket sets in which configured sockets of different dimensions are used to engage different nut and bolt sizes and a ratchet handle is typically provided with an adjustable rotational ratchet orientation drive mechanism engaged on the socket head so that a nut or bolt can be selectively rotated in one direction without removing the socket head from the bolt. Socket extensions are also used in the art to extend the effective length of the use socket.

2. Description of Prior Art

Prior art patents of this type have been directed to a variety of different socket wrench head configurations that have different pivoting head configurations, see for example U.S. Pat. Nos. 1,747,527, 1,811,137, 6,637,299 6,971,292, 7,024,970, 7,036,403, 7,044,028, 7,246,543 and 7,316,172.

A number of these patents have socket heads in offset angular relation to their handles; see Patents ending in 403 and 172.

In Patent ending in 137 discloses a fully rotatable socket head in a gimble type mount with angular offset handle between two socket heads in oppositely disposed relation to one another.

A one axis pivoting socket head can be seen in U.S. Patent ending in 403 with a fixed non-ratchet socket opening wrench head on its oppositely disposed end.

U.S. Pat. No. 1,747,527 is directed to a wrench having two sections pivotally secured at their handles with an indexing pin engaged in notches.

U.S. Pat. No. 6,637,299 illustrates a wrench with rotating heads having a pair of different sized wrench surfaces for selective alternate alignment within the support yolk.

U.S. Pat. No. 7,246,534 discloses an adjustable wrench with a pair of ratchet fittings pivotally secured to the handles for selective alternate engagement therewith.

Finally, a dual angle offset socket is shown in U.S. Patent ending in 970.

SUMMARY OF THE INVENTION

A multiple axis dual head socket wrench tool having oppositely disposed rotating socket ratchet fastener heads secured to one another by pivoting corresponding handles. Each of the socket heads has a ratchet extension receiving fitting accessible through the rotating ratchet socket head so socket extensions can be used when needed. The tool provides translateral and transverse orientation of socket ratchet heads to accommodate a variety of different fastener engagement location venues.

DETAILED DESCRIPTION OF THE INVENTION

Figure 1:
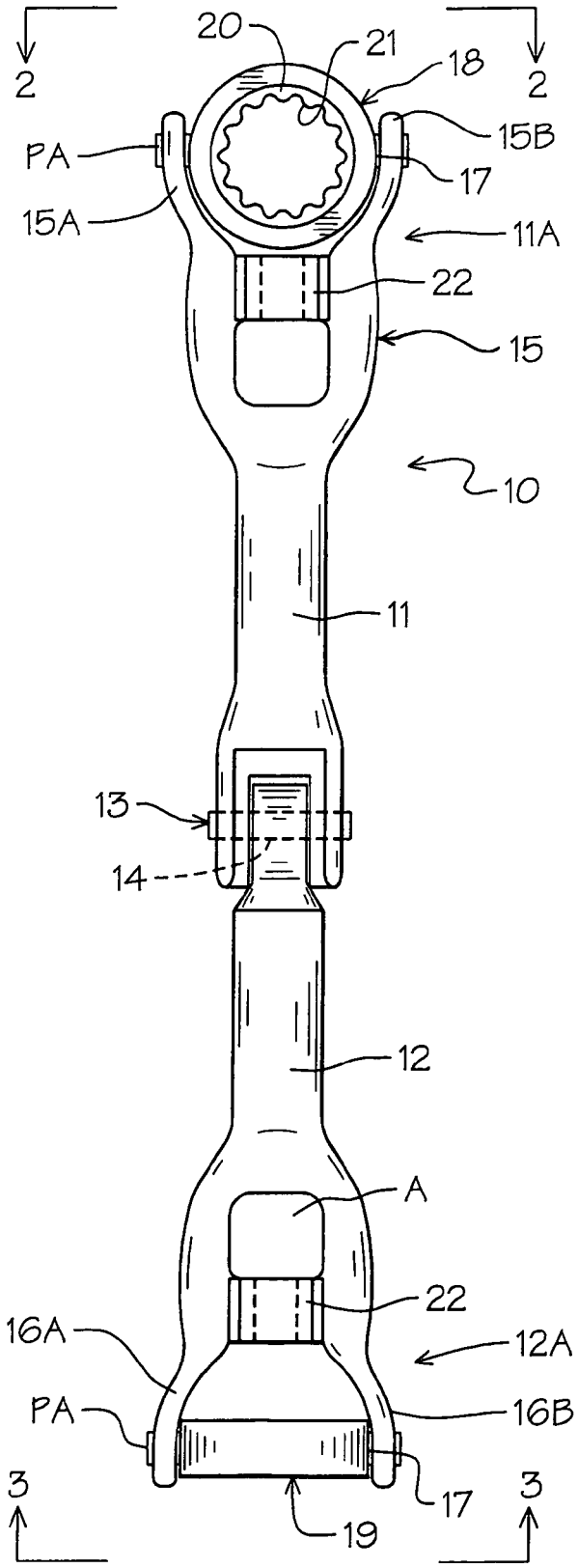
FIG. 1 is a front elevational view of the wrench of the invention.
Figure 2:
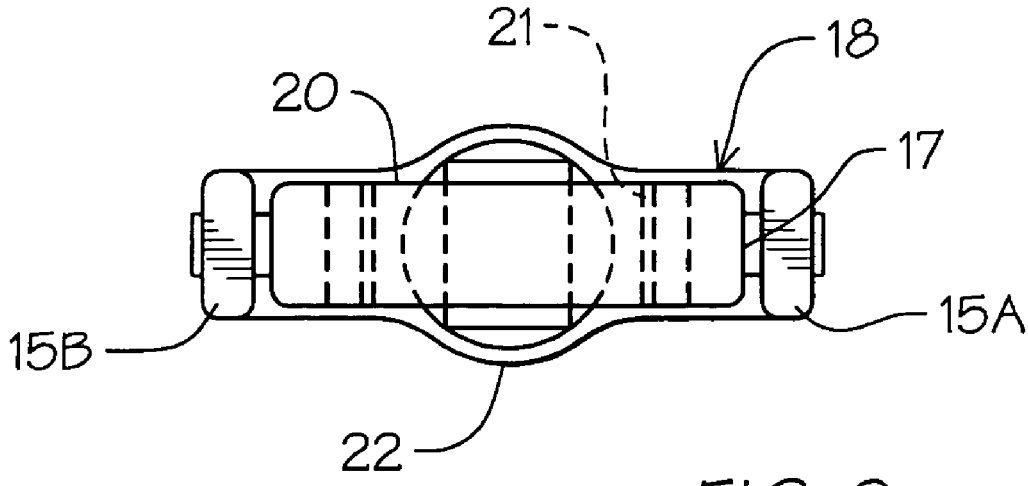
FIG. 2 is an end elevational view of the wrench in basic position on lines 2-2 of FIG. 1.
Figure 3:
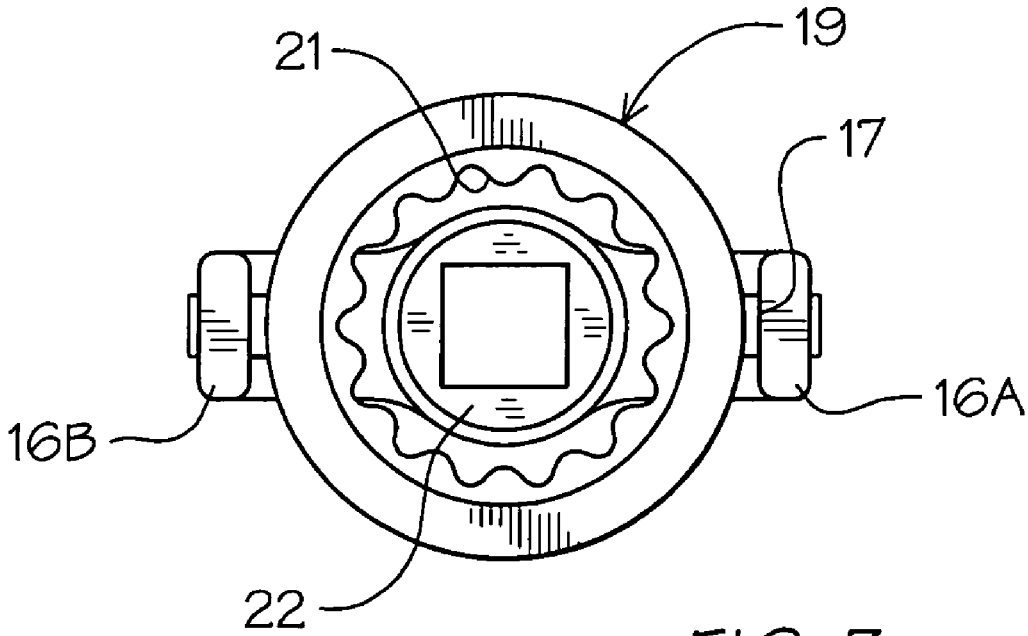
FIG. 3 is an end elevational view of the wrench on lines 3-3 of FIG. 1.
Figure 4:
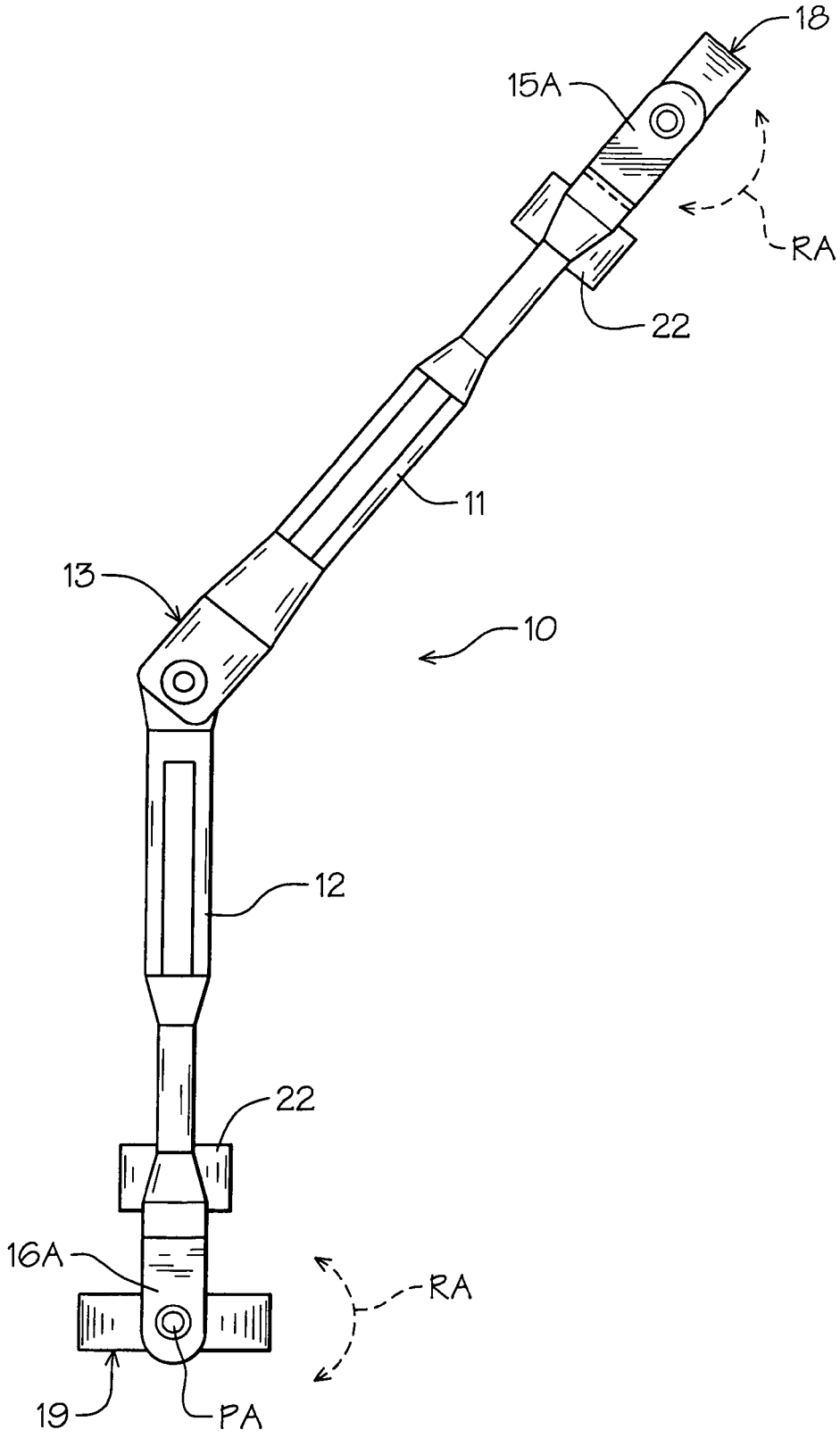
FIG. 4 is a side elevational view of the wrench in pivoted position.

Referring to FIGS. 1 and 4 of the drawings a combination socket wrench 10 of the invention can be seen having a pair of handle portions 11 and 12 pivoted together at 13 at their respective ends by a central pivot pin 14. Each of the handle portions 11 and 12 have a socket mounting end 11A and 12A respectively with a finger access aperture A extending therethrough a portion of increased transverse dimension at 15.

The finger access aperture A will allow for a user's finger (not shown) to be inserted for ease of rapid initial rotation of the handle portion associated therewith when the socket wrench 10 first engages a fastener (not shown) as is typical in the art.

Each of the socket mounting ends 11A and 12B are bifurcated defining contoured oppositely disposed aligned armatures 15A and 15B, 16A and 16B respectively defining a gimble pivot mount 17 for respective ratchet socket assemblies 18 and 19. Each of the ratchet socket assemblies 18 and 19 have a mounting ring 20 with a ratchet insert 21 that allows for selective engagement over a fastener (not shown) and one directional rotation thereof. Such ratchet assemblies are well known and understood within the art.

It will be seen that the respective ratchet socket assemblies 18 and 19 can be rotated 360° about their central pivoted axis.

Each of the apertured handle portions 11 and 12 has a fixed socket extension receiving fitting 22 in aligned orientation to the respective handle portions 11 and 12.

Figure 5:
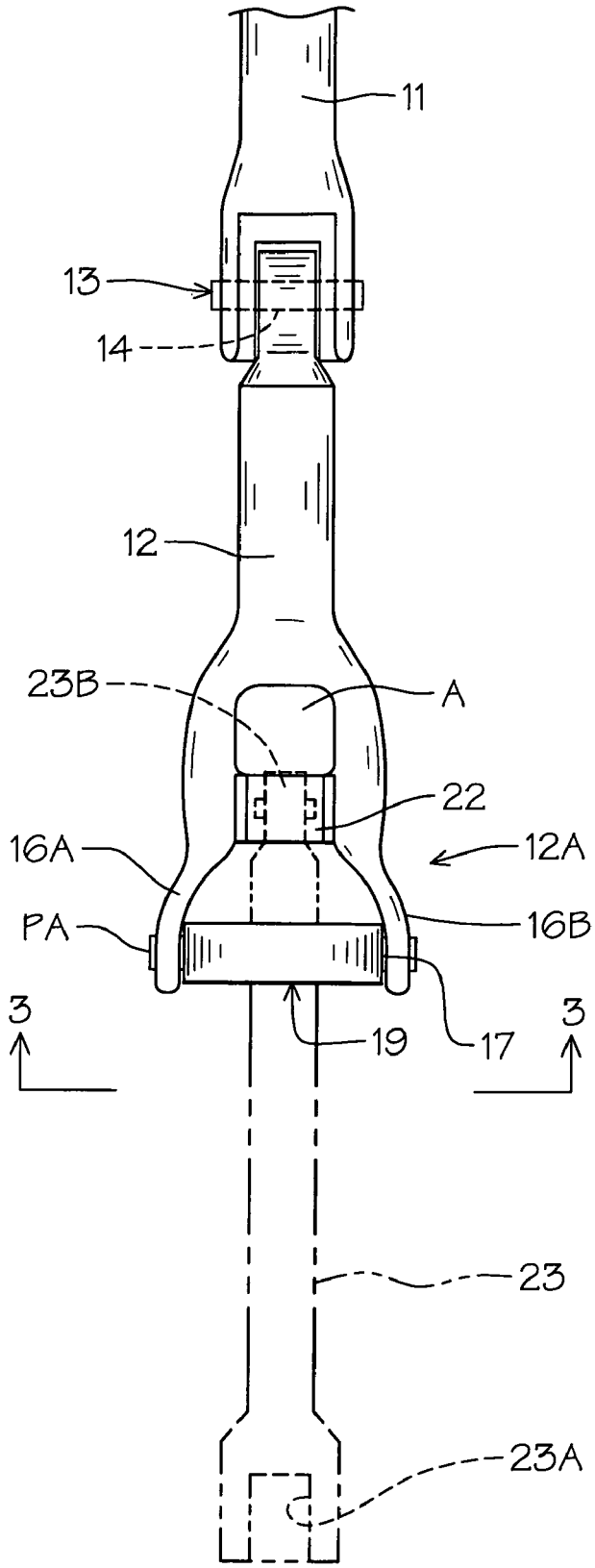
FIG. 5 is a partial front elevational view of the wrench of the invention with a socket extension shown in broken lines engaged therein.

It will be seen that by rotation of the respective ratchet socket assemblies 18 and 19 to a ninety degree orientation that the fixed socket extension receiving fittings 22 are accessible to receive a corresponding common socket extension element 23 as shown in broken lines in FIG. 5 of the drawings, adding additional length to the tool for improved access to the fasteners, as well understood within the art (not shown).

It will be evident from the above description that by combining the central pivot at 13 between the respective ratchet handle portions 11 and 12 and socket assemblies 18 and 19 which in turn are fully rotatable 360° within their respective gimble mountings, that a variety of socket use engagement positions can be achieved by the combination socket wrench 10 of the invention. Such positioning defines leverage advantages as seen for example in FIG. 4 of the drawings in which the handle portion 11 which can be locked in different angular orientations.

Referring now to FIG. 5 of the drawings, the handle portion 12 with the gimble mounted ratchet socket assembly 19 can be seen rotated to allow direct access insertion of the socket extension 23 (as noted) to improve usefulness of the tool.

The socket extension 23 provides a length extension with a female socket fitting end 23A and a male socket fitting end 23B thereon, again as is well established and known to those skilled in the art.

It will thus be seen that a new and useful multiple head pivoted configuration socket wrench device of the invention has been illustrated and described and it will be apparent to those skilled in the art that various changes and modifications may be made thereto without departing from the spirit of the is invention.

Therefore I claim:

1. A socket wrench apparatus comprising, a first ratchet socket having a first ratchet insert therein, said first ratchet socket pivotally mounted within a first bifurcated socket mounting end, a first lever handle portion extending from said socket mounting end, a second ratchet socket having a second ratchet insert therein, said second ratchet socket pivotally mounted within a second bifurcated socket mounting end, a second lever handle portion extending from said second socket mounting end, said first lever handle portion pivotally secured to said second lever handle portion at their respective free end, a first fixed socket extension receiving fitting in said first lever handle portion between said first socket mounting end and a finger engagement opening in said first lever handle portion, a second fixed socket extension receiving fitting in said second lever handle portion between said second socket mounting end and a finger engagement opening in said second lever handle portion.

2. The socket wrench apparatus set forth in claim 1 wherein said first and second ratchet socket each has a gimbled axis of rotation perpendicular to the longitudinal axis of said respective first and second lever handle portions.

3. The socket wrench apparatus set forth in claim 1 wherein said first and second fixed socket extensions are in alignment with the longitudinal axis of said respective first and second lever handle portions.

4. The socket wrench apparatus set forth in claim 1 wherein said pivoted first and second lever handle portions define angled offset orientation to one another for enhanced leverage application to the respective ratchet sockets.

* * * * *